US005850818A

United States Patent [19]

Yoshiume et al.

[11] Patent Number: 5,850,818

[45] Date of Patent: Dec. 22, 1998

[54] FUEL SUPPLY APPARATUS HAVING ABNORMALITY DETECTING FUNCTION

[75] Inventors: Naoki Yoshiume; Makoto Miwa, both of Kariya, Japan

[73] Assignee: Nippondenso Co., Ltd., Kariya, Japan

[21] Appl. No.: 707,251

[22] Filed: Sep. 3, 1996

[30] Foreign Application Priority Data

Sep. 27, 1995 [JP] Japan ..... 7-248940

[51] Int. Cl.[6] ..... F02M 37/04

[52] U.S. Cl. ..... 123/497; 123/198 D

[58] Field of Search ..... 123/497, 198 D; 417/42

[56] References Cited

U.S. PATENT DOCUMENTS

| | | | |
|---|---|---|---|
| 4,827,897 | 5/1989 | Yamada et al. | 123/497 |
| 5,284,119 | 2/1994 | Smitley | 123/497 |
| 5,291,578 | 3/1994 | Kalami | 123/497 |
| 5,345,915 | 9/1994 | Schmitz-Huebsch et al. | 123/497 |
| 5,355,859 | 10/1994 | Weber | 123/497 |
| 5,379,741 | 1/1995 | Matysiewicz et al. | 123/497 |
| 5,406,922 | 4/1995 | Tuckey | 123/497 |
| 5,555,872 | 9/1996 | Takeuchi et al. | 123/198 D |

FOREIGN PATENT DOCUMENTS

| | | |
|---|---|---|
| A-57-68529 | 4/1982 | Japan . |
| A-63-219867 | 9/1988 | Japan . |
| A-3-156191 | 7/1991 | Japan . |
| A-5-195894 | 8/1993 | Japan . |
| U-6-28259 | 4/1994 | Japan . |
| A-7-27029 | 1/1995 | Japan . |

*Primary Examiner*—Thomas N. Moulis
*Attorney, Agent, or Firm*—Nixon & Vanderhye P.C.

[57] ABSTRACT

Electric current to a fuel pump in an engine fuel supply system is controlled so that a deviation in the number of pump rotations between a predetermined reference number of rotations of the fuel pump and an actual number of rotations thereof is within a predetermined range. When the deviation exceeds a predetermined range, it is determined that the fuel supply system is abnormal and at this time the operation of the fuel pump is limited. In this manner, the electric power consumed by the fuel pump is reduced because excess fuel is not circulated in the fuel supply system, thus accomplishing an improved reliability.

38 Claims, 12 Drawing Sheets

FUEL SUPPLY APPARATUS HAVING ABNORMALITY DETECTING FUNCTION

BACKGROUND OF THE INVENTION

1. Field of the Invention

The present invention relates to a non-return type of fuel supply apparatus of an internal combustion engine capable of promptly detecting an abnormality which has occurred in the fuel supply system.

2. Description of Related Art

In U.S. Pat. No. 5,355,859, there is disclosed a non-return fuel system having no return pipe for returning excess fuel from a fuel rail or the like to a fuel tank. In the non-return system, the pressure of fuel to be supplied to injectors is adjusted by a fuel pump.

In the non-return system, however, when a fuel supply system including the fuel pump has become abnormal, the pressure of fuel to be supplied to the injectors does not attain a target value. This greatly affects the air-fuel ratio of air-fuel mixture to be supplied to an internal combustion engine. In particular, the non-return system in which the fuel pump is controlled by an open loop is not provided with a fuel sensor for detecting the pressure of the fuel. Thus, it can be improved by detecting an abnormality of the fuel supply system promptly and countering the abnormality.

SUMMARY OF THE INVENTION

It is accordingly an object of the present invention to provide a fuel supply apparatus of a non-return fuel supply system capable of promptly detecting an abnormality which has occurred in a fuel supply system.

It is another object of the present invention to provide a fuel supply apparatus capable of appropriately countering a detected abnormality.

According to the present invention, an actual fuel pump rotational condition is detected and compared with a predetermined reference and an abnormality is determined based on the comparison result. The actual rotational condition may be a rotational speed or change in a rotational speed, and the reference may be determined to vary in accordance with the operating condition or drive state of an engine.

Preferably, the abnormality determination is disabled at the time of engine starting.

Preferably, when the abnormality of the fuel pump or fuel supply system is determined, an electric current to an electric motor of the fuel pump is increased and decreased in response to excessively low and high fuel pump rotational speed, respectively.

BRIEF DESCRIPTION OF THE DRAWINGS

Other objects, features and advantages of the present invention will become more apparent from the following description when read in conjunction with the accompanying drawings, in which:

FIGS. 9A to 9C are time charts showing transition of the fuel pressure, the number of rotations of the fuel pump, and supply electric current, with the lapse of time in relation to a time when the ignition switch is turned on;

DETAILED DESCRIPTION OF PRESENTLY PREFERRED EMBODIMENTS

A fuel supply system of an internal combustion engine (hereinafter referred to as an engine) in accordance with preferred embodiments of the present invention will be described below with reference to the accompanying drawings.

Figure 1:
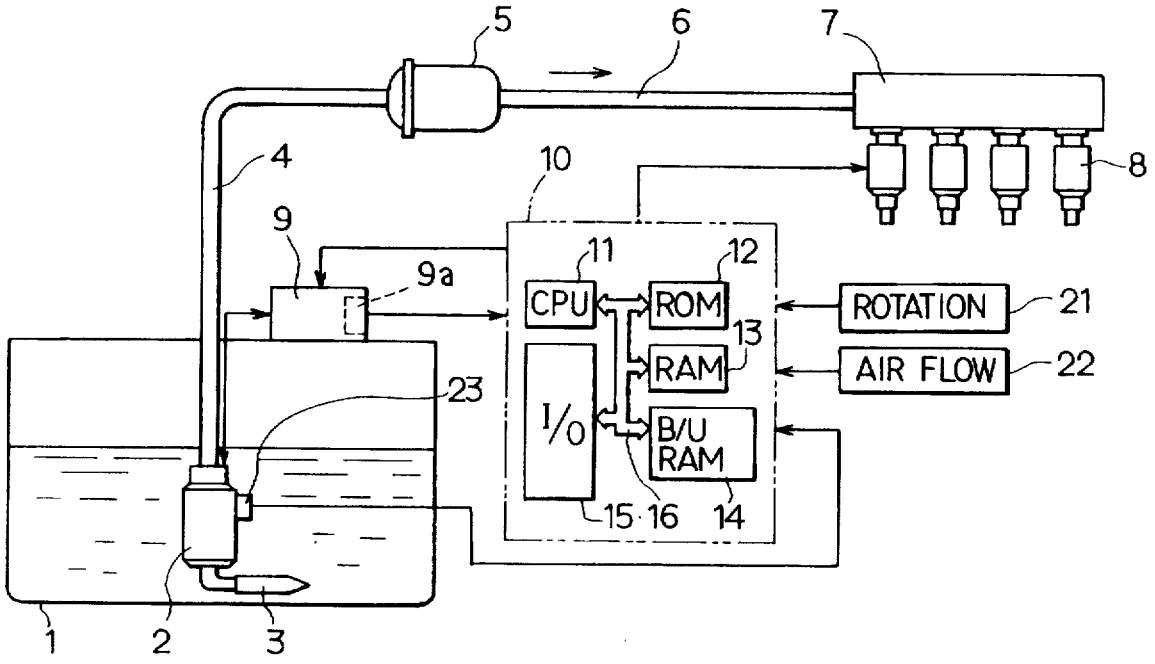
FIG. 1 is a schematic view showing the entire construction of a fuel supply apparatus of an internal combustion engine according to an embodiment of the present invention.

Referring to FIG. 1, a fuel pump 2 (hereinafter referred to as F/P 2) is provided in a fuel tank 1, and a low pressure fuel filter 3 is connected with the intake side of the F/P 2. A high pressure fuel filter 5 is connected with the discharge side of the F/P 2 through a fuel pipe 4, and a fuel rail 7 is connected with the discharge side of the high pressure fuel filter 5 through a fuel pipe 6. The fuel rail 7 is connected with fuel injection valves 8 which inject fuel to cylinders of the engine. The number of the fuel injection valves 8 corresponds to that of the cylinders of the engine. A constant-current control circuit 9 controls the intensity of electric current to be supplied from an unshown battery mounted on a car to the F/P 2. An ECU 10 (electronic control unit) controls the fuel injection valves 8 and the constant-current control circuit 9.

The ECU 10 comprises a CPU 11, a ROM 12, a RAM 13, a B/U (back-up) RAM 14, an input/output circuit 15, and a bus line 16 for connecting those circuit components to one another. The ECU 10 is connected with a sensor 21 for detecting the number of rotations (rotation speed) NE of the engine, an air flow meter 22 for detecting an intake air amount QA, and a voltage sensor 23 for detecting the voltage to the F/P 2. Signals detected by the sensor 21, the air flow meter 22, and the voltage sensor 23 are inputted to the CPU 11 through the input/output circuit 15. The ECU 10 is also connected with the fuel injection valves 8 and the constant-current control circuit 9, thus outputting control signals thereto. The constant-current control circuit 9 is provided with a detection portion 9*a* for detecting the number of rotations of the F/P 2, based on pulsations of electric current. A signal indicating the result obtained by the detection portion 9*a* is inputted to the CPU 11 through the input/output circuit 15.

In the above-described construction, the fuel filter 3 removes large foreign matters from the fuel when the F/P 2 provided in the fuel tank 1 pumps the fuel. The fuel pumped up by the F/P 2 is sent or discharged to the high pressure fuel filter 5 through the fuel pipe 4. The high pressure fuel filter 5 removes small foreign substances and water from the fuel, and the filtered fuel is sent to the fuel rail 7 through the fuel pipe 6. The fuel supplied under pressure to the fuel rail 7 is injected from the fuel injection valves 8 to intake ports of the unshown engine.

The fuel supply apparatus is thus constructed as a non-return or returnless fuel supply system. That is, the apparatus does not have a return pipe for returning the fuel from the fuel rail 7 to the fuel tank 1. Therefore, as will be described later, the constant-current control circuit 9 controls the intensity of electric current to be supplied to an unshown pump motor (DC motor) provided in the F/P 2 so that the fuel pressure inside the fuel rail 7 (hereinafter referred to as merely "fuel pressure") is kept constant with respect to the amount of fuel injected from the fuel rail 7.

Figure 2:
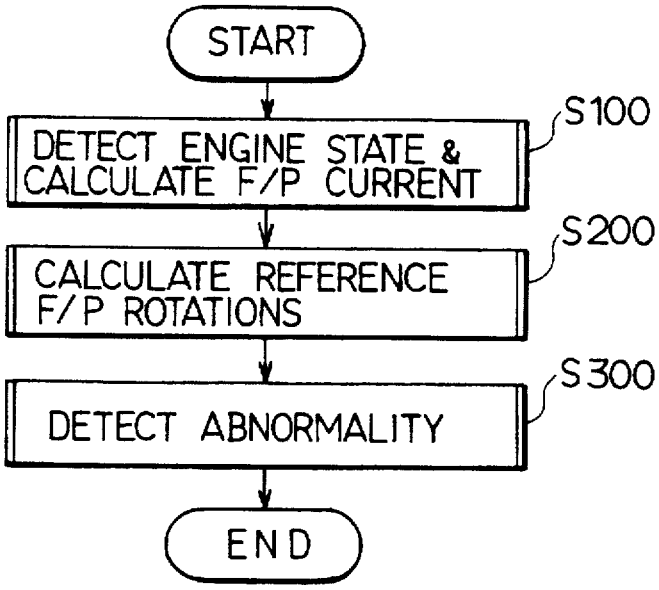
FIG. 2 is a flowchart showing a schematic processing procedure of a control to be performed by a CPU of an ECU provided in the fuel supply apparatus of the embodiment.

In FIG. 2 showing the schematic processing procedure of the control to be performed by the CPU 11 of the ECU 10, at step S100, the drive state of the engine is detected to control it and detect abnormality in the fuel supply system, and the intensity of electric current to be supplied to the F/P 2 is calculated so that the fuel pressure is constant. Then, at step S200, a reference number of rotations of the F/P 2 is calculated based on the drive state of the engine detected at step S100. Then, at step S300, abnormality of the fuel supply system is detected based on the deviation between the reference number of rotations of the F/P 2 calculated at step S200 and an actual number of rotations of the F/P 2 detected by the detection portion 9*a*, and processing corresponding to the result obtained by the detection is executed. Then, the processing of the routine terminates.

Figure 3:
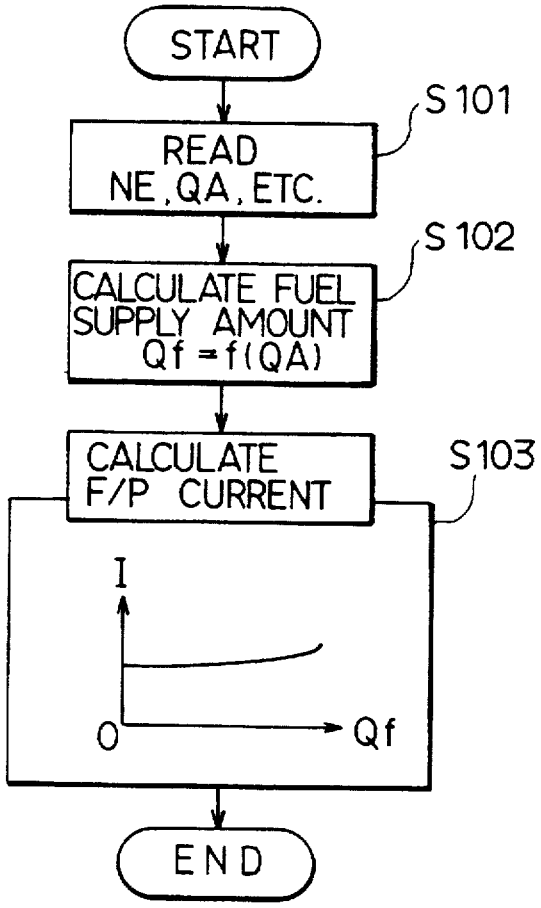
FIG. 3 is a flowchart showing a detailed processing procedure for detecting the drive state of the internal combustion engine and calculating the intensity of electric current to be supplied to a fuel pump.

In FIG. 3 showing details of step S100, initially, at step S101, the CPU 11 reads various data, for example, an intake air amount QA detected by the air flow meter 22, the number of rotations NE of the engine detected by the sensor 21 or the like to detect the drive state of the engine so as to control the engine and detect abnormality. Then, at step S102, the CPU 11 calculates an amount Qf of fuel to be supplied (hereinafter referred to as merely fuel supply amount Qf) from the F/P 2 to the fuel rail 7 from Qf=f (QA), based on the intake air amount QA detected by the air flow meter 22. Then, at step S103, the CPU 11 calculates the intensity of the electric current (I) to be supplied to the F/P 2 (hereinafter referred to as merely supply electric current (I)) in correspondence to the fuel supply amount Qf calculated at step S102 based on a table stored in the ROM 12 of the ECU 10, thus terminating the processing of this routine.

Figure 4:
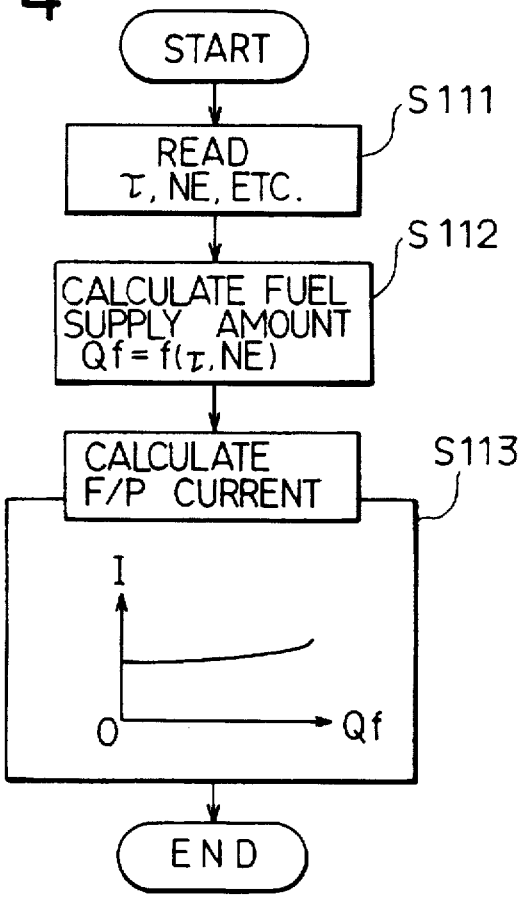
FIG. 4 is a flowchart showing another detailed processing procedure for detecting the drive state of the engine and calculating the intensity of electric current to be supplied to the fuel pump.

Alternatively, the step S100 may be performed as shown in FIG. 4. Initially, at step Sill, the CPU 11 reads various data to detect the drive state of the engine necessary for the control of the engine and the detection of abnormality. That is, the CPU 11 reads the width τ of pulse to be applied to the fuel injection valves 8 which is determined from the intake air amount QA detected by the air flow meter 22; the number of rotations NE of the engine detected by the sensor 21; and other data. Then, at step S112, the CPU 11 calculates the fuel supply amount Qf from Qf=f (τ, NE), based on the pulse width τ and the number of rotations NE of the engine. Then, at step S113, the CPU 11 calculates the intensity of the supply electric current (I) in correspondence to the fuel supply amount Qf calculated at step S112, based on the table stored in the ROM 12 of the ECU 10, thus terminating the processing of this routine.

Figure 5:
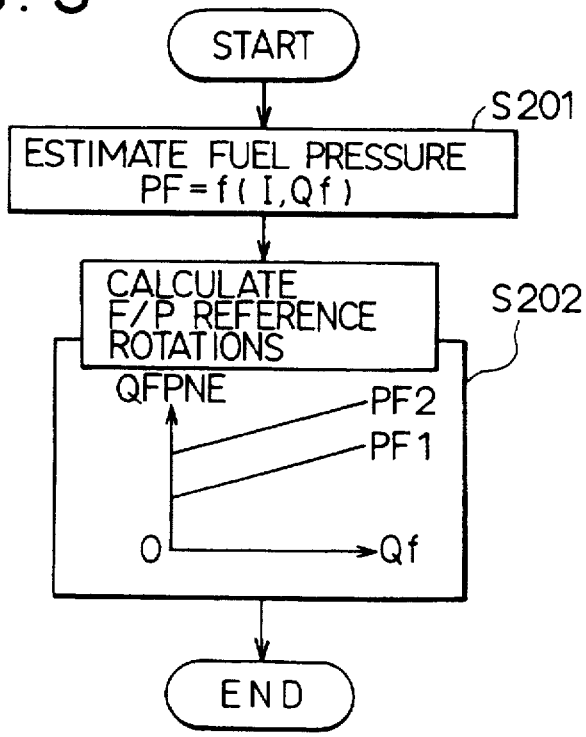
FIG. 5 is a flowchart showing a detailed processing procedure for calculating a reference number of rotations of the fuel pump.
Figure 6:
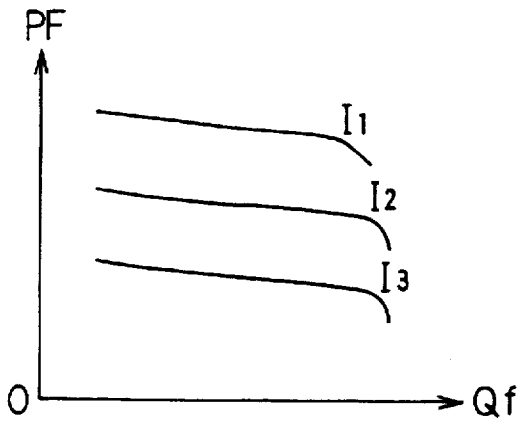
FIG. 6 is a characteristic chart showing the relationship between the amount of fuel to be supplied to a fuel rail and a fuel pressure, using electric current as a parameter.
Figure 7:
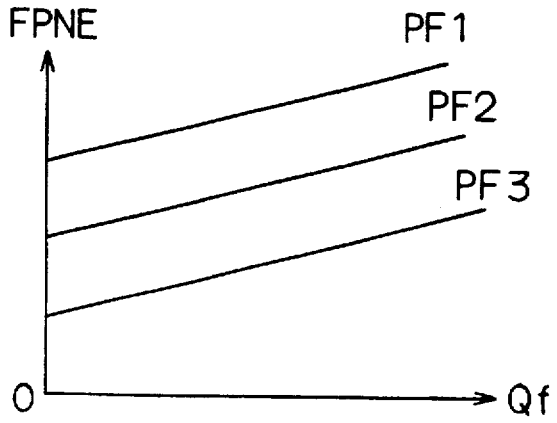
FIG. 7 is a characteristic chart showing the relationship between the amount of fuel to be supplied to the fuel rail and the number of rotations of the fuel pump, using a fuel pressure as a parameter.

FIG. 5 is a flowchart showing a detailed processing procedure, to be executed at step S200 shown in FIG. 2, for calculating the reference number of rotations of the F/P 2. The processing procedure for calculating the reference number of rotations of the F/P 2 is described below with reference to a characteristic chart of FIG. 6 showing the relationship between the fuel supply amount Qf and the fuel pressure PF when the supply electric current (I) is constant (I1>I2>I3). FIG. 6 is a characteristic chart showing the relationship between the fuel supply amount Qf and the fuel pressure, using electric current as a parameter. FIG. 7 is a characteristic chart showing the relationship between the fuel supply amount Qf and the number of rotations of the F/P 2, using the fuel pressure as a parameter.

As shown in FIG. 6, when the supply electric current (I) is constant, the fuel pressure PF will drop as the fuel supply amount Qf increases. In the embodiment, the supply electric current (I) is corrected to allow the fuel pressure PF to be constant. When the state of the fuel supply system is normal, the number of rotations FPNE of the F/P 2 is determined from the fuel supply amount Qf and the fuel pressure PF (PF1>PF2>PF3) as shown in FIG. 7. The higher the fuel pressure PF is, the greater the number of rotations FPNE of the F/P 2 is, supposing that the fuel supply amount Qf is constant.

In FIG. 5, at step S201, an estimated value of the fuel pressure PF is calculated based on the characteristic of FIG. 6 in which the supply electric current (I) is used as a parameter. At step S202, the reference number QFPNE of rotations of the F/P is calculated from the fuel supply amount Qf calculated at steps S102 or S112 and the estimated value of the fuel pressure PF calculated at step S201, based on the table stored in the ROM 12 of the ECU 10. The table indicates the relationship established between the fuel supply amount Qf and the reference number QFPNE of rotations of the F/P, by using the fuel pressure PF as a parameter.

As described previously, when the supply electric current (I) is calculated from the fuel supply amount Qf so that the fuel pressure PF is constant, the processing to be executed at step S201 shown in FIG. 5 can be omitted. Further, when the fuel rail 7 shown in FIG. 1 is provided with a fuel sensor and thus when the fuel pressure PF is directly detected, the fuel pressure PF may be read at step S101 shown in FIG. 3 or step S111 shown in FIG. 4.

Figure 8:
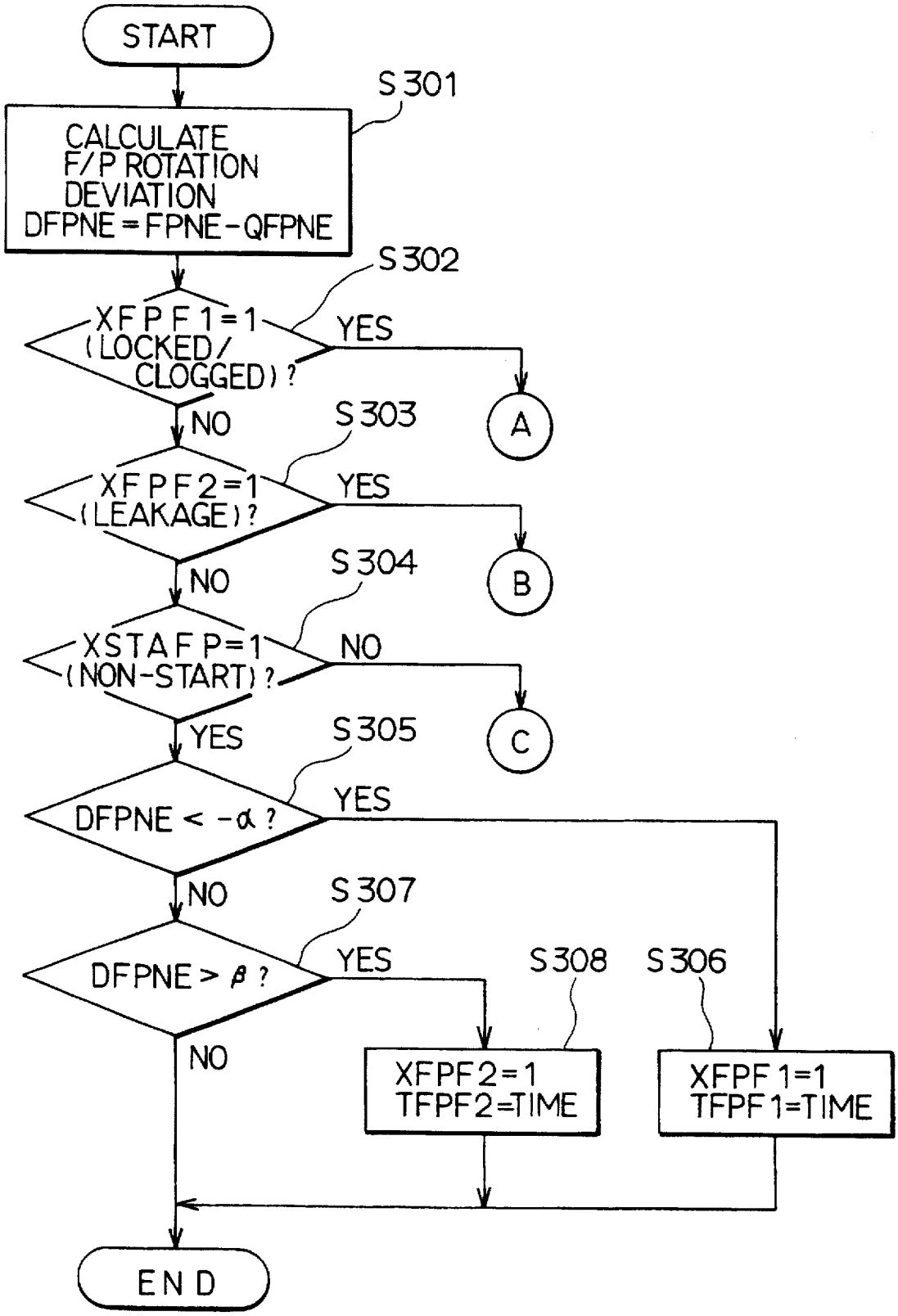
FIG. 8 is a flowchart showing a detailed processing procedure for detecting abnormality which has occurred in the fuel supply system.

FIG. 8 is a flowchart showing a detailed processing of step S300, in detecting abnormality which has occurred in the fuel supply system. FIG. 9 is a time chart showing the transition of the fuel pressure PF, the number of rotations FPNE of the F/P 2, and the supply electric current (I), with the lapse of time in relation to a time (TIME=0) when the ignition switch is turned on.

Initially, at step S301, the deviation DFPNE in the number of rotations of the F/P 2 is calculated by subtracting the reference number QFPNE of rotations of the F/P 2 calculated at step S202 of FIG. 5 from the actual number of rotations FPNE of the F/P detected by the detection portion 9a. Then, it is determined at step S302 whether or not a flag XFPF1 has been set to "1". The flag XFPF1=1 indicates a locked state in which a foreign substance has been caught in rotational portions of the F/P 2 or indicates a clogged state in which the fuel pipe 4 or 6 has been clogged with foreign substances. If YES at step S302, a processing routine to be used in the locked state or the clogged state which will be described later is executed.

If NO at step S302, i.e., if it is determined that the flag XFPF1 which is reset to "0" when the ignition switch is ON is "0" because the fuel supply system is not in the locked state or the clogged state, the program goes to step S303 at which it is determined whether or not a flag XFPF2 indicating the leakage of the fuel from the fuel pipe 4 or 6 has been set to "1". If YES at step S303, a processing routine to be executed at the fuel-leaking state is executed, as will be described later.

If NO at step S303, i.e., if it is determined that the flag XFPF2 which is reset to "0" when the ignition switch is ON is "0" because the fuel supply system is not in the fuel-leaking state, the program goes to step S304 at which it is determined whether or not a flag XSTAFP has been set to "1". The flag XSTAFP=1 indicates the non-start time of the engine, namely, a predetermined time period from the start time of the engine until the time when the operation of the F/P 2 stabilizes. The flag XSTAFP is reset to "0" when the ignition switch is ON. It is difficult to calculate the reference number QFPNE of rotations of the F/P 2 until the fuel pressure at the start time of the engine rises up to the predetermined fuel pressure PF and thus there is a high possibility that an erroneous determination is made. Therefore, if NO at step S304, a routine to be executed at the start time of the engine is used, as will be described later.

Figures 9A, 9B, 9C:
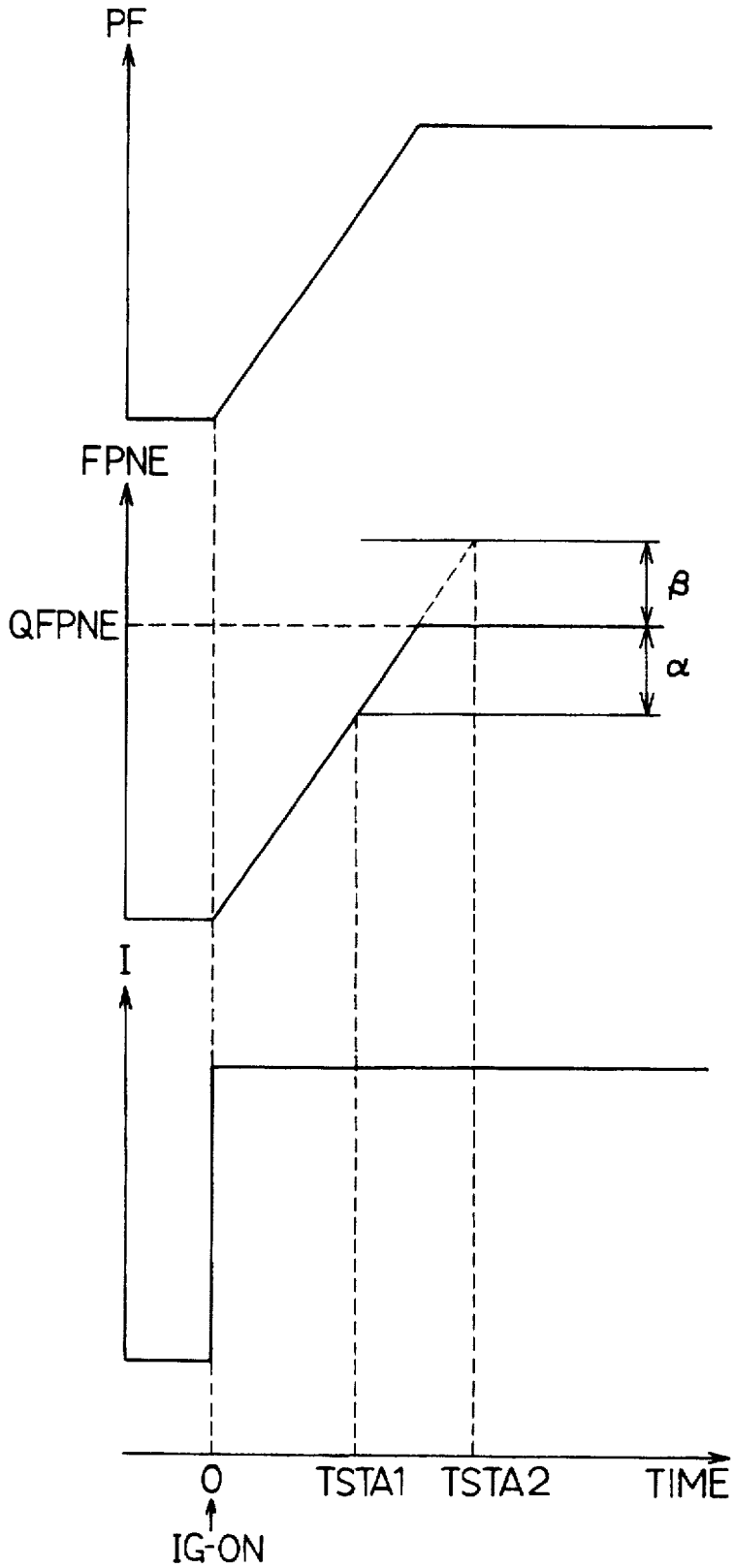

If YES at step S304, i.e., when it is determined that the engine is not at the start time, the program goes to step S305 at which it is determined whether or not the deviation DFPNE in the number of rotations of the F/P 2 is less than a predetermined lower limit deviation $-\alpha$, namely, whether or not the actual number FPNE of rotations of the F/P 2 at the time when a predetermined time period has elapsed in relation to TIME=0 (time when the ignition switch is ON) is smaller than a number of rotations obtained by subtracting the predetermined number of rotations $-\alpha$ from the reference number QFPNE of rotations of the F/P (see FIGS. 9A to 9C). If YES at step S305, the program goes to step S306 at which the flag XFPF1 is set to "1" to indicate the locked state or the clogged state, and the time when the flag XFPF1 has been set to "1" is stored as time TFPF1. Then, the processing of this routine terminates.

If NO at step S305, the program goes to step S307 at which it is determined whether or not the deviation DFPNE in the number of rotations of the F/P 2 is greater than a predetermined upper limit deviation $\beta$ namely, whether or not the actual number FPNE of rotations of the F/P 2 at the time when the predetermined time period has elapsed in relation to TIME=0 (time when the ignition switch is ON) is greater than the number of rotations obtained by adding the predetermined number of rotations $\beta$, to the reference number QFPNE of rotations of the F/P 2 (see FIG. 9.) If YES at step S307, the program goes to step S308 at which the flag XFPF2 is set to "1" indicating the fuel-leaking state, and the time when the flag XFPF2 has been set to "1" is stored as a time TFPF2. Then, the processing of this routine terminates. If NO at step S307, it is determined that the state of the fuel supply system is normal because the deviation DFPNE in the number of rotations of the F/P 2 is smaller than the predetermined upper limit deviation $\beta$. Then, the processing of this routine terminates.

The processing procedure to be executed in the locked state or the clogged state is described below with reference to a routine shown in FIG. 10, when it is determined at step S302 that the fuel supply system is in the locked state or the clogged state.

Figure 10:
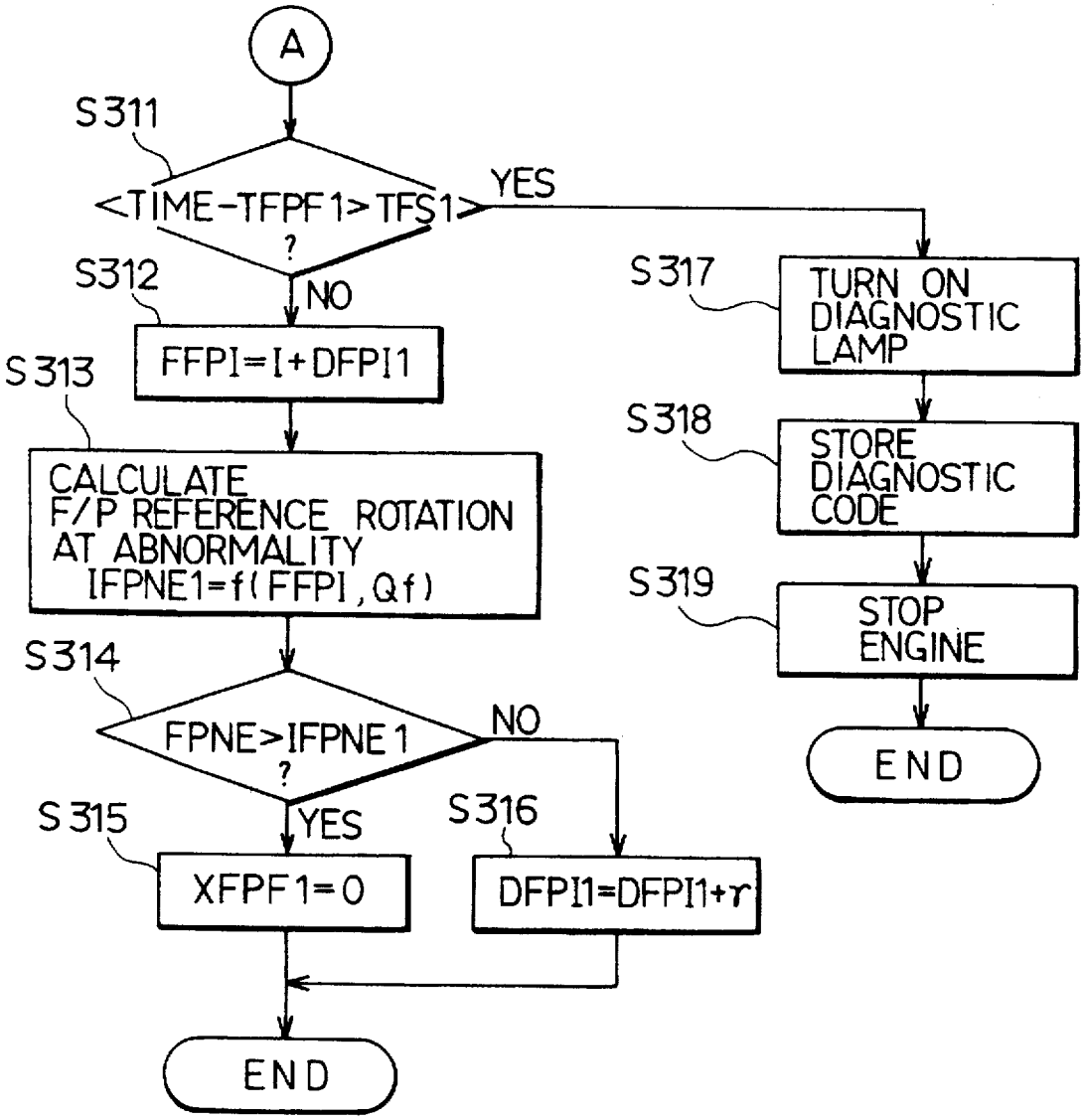
FIG. 10 is a flowchart showing a processing procedure, in a locked state or a clogged state.

FIG. 10 is a flowchart showing the processing procedure, in the locked state or the clogged state, to be performed by the CPU 11 of the ECU 10.

Initially, it is determined at step S311 whether or not the time period from the time TFPF1 when abnormality has been detected at step S306 of FIG. 8 until a current TIME is more than a predetermined time period TFS1 set, based on the deviation DFPNE in the number of rotations of the F/P 2 at the time when the abnormality has been detected and the fuel supply amount Qf so as to enable a safe travel of the car after the F/P 2 has stopped the supply of the fuel to the fuel rail 7. If NO at step S311, the program goes to step S312 at which a predetermined correction value DFPI1 is added to the supply electric current (I) calculated at step S100 of FIG. 2 so as to calculate the corrected supply electric current FFPI. In this manner, the supply electric current (I) is increased to increase the torque of the F/P 2. That is, the fuel pressure PF is increased to eliminate the cause of locking or clogging. It is to be noted that an allowance is given to the predetermined correction value DFPI1 in consideration of a failure due to burn-out or the like of the fuel supply system when the intensity of electric current increases. The predetermined correction value DFPI1 is set based on the supply electric current (I) at the time when abnormality has been detected.

Then, the program goes to step S313 at which the abnormality-time reference number IFPNE1 of rotations of the F/P 2 used to determine whether or not an abnormal state has been returned to a normal state is calculated from IFPNE1=f (FFPI, Qf), based on the corrected supply electric current FFPI calculated at step S312 and the fuel supply amount Qf. Then, the program goes to step S314 at which it is determined whether or not the actual number of rotations FPNE of the F/P 2 is greater than the abnormality-time reference number IFPNE1 of rotations of the F/P 2. If YES at step 314, i.e., if it is determined that the normal state has been recovered from the abnormal state, the program goes to step S315 at which the flag XFPF1 indicating the locked state or the clogged state is reset to "0". Then, the processing of this routine terminates. If NO at step S314, i.e., if it is determined that the abnormal state still continues, the program goes to step S316 at which the predetermined correction value DFPI1 is increased by a predetermined value $\gamma$. Then, the processing of this routine terminates. The predetermined value $\gamma$ is set in such a manner that the corrected supply electric current FFPI does not exceed the limit value even though it is repeatedly increased during the predetermined time period TFS1.

If YES at step S311, i.e., if the time period between the time TFPF1 at which the abnormality has been detected and the current time has exceeded the predetermined time period TFS1, it is determined that the fuel supply system is in an abnormal state (locked state or clogged state). Then, the program goes to step S317 at which a diagnostic lamp which informs a driver of abnormality is turned on. Then, the program goes to step S318 at which a diagnostic code is stored for each type of abnormality. The diagnostic code is kept to be stored until it is checked for repair in a repair shop or the like. Then, the program goes to step S319 at which the engine is stopped for safety. Then, the processing of this routine terminates.

The processing procedure to be executed in the fuel-leaking state is described below with reference to a routine shown in FIG. 11, when it is determined at step S303 that the fuel supply system is in the fuel-leaking state.

Figure 11:
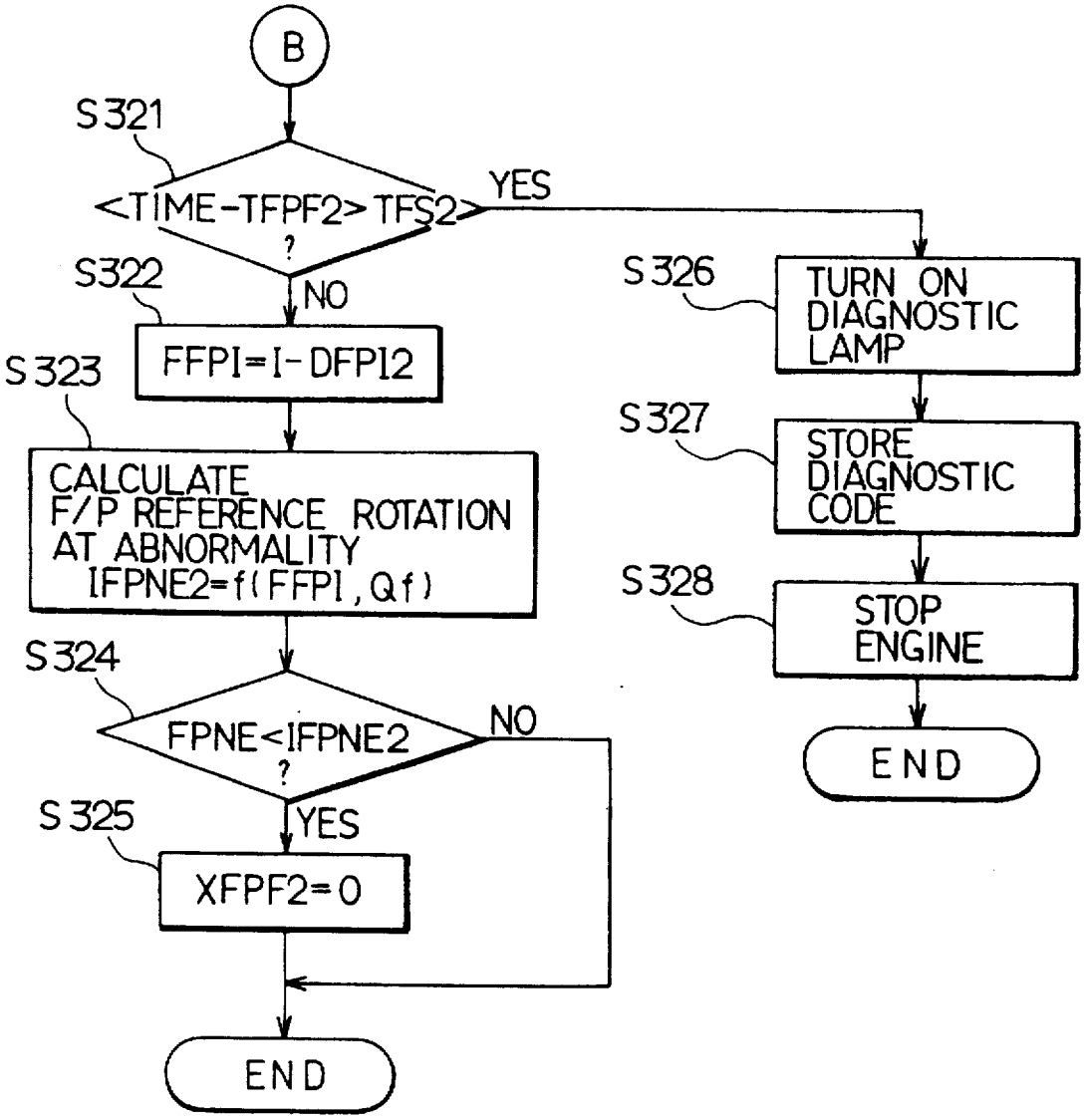
FIG. 11 is a flowchart showing a processing procedure, in a fuel-leaking state.

FIG. 11 is a flowchart showing a processing procedure, in a fuel-leaking state, to be performed by the CPU 11 of the ECU 10. It is determined at step S321 whether or not the time period between the time TFPF2 when abnormality has been detected at step S308 and the current time is longer than a predetermined time period TFS2 to ensure a safe travel of the car after the fuel has leaked. The predetermined time period TFS2 is set based on the abnormality-detection time deviation DFPNE in the number of rotations of the F/P 2 at the time when abnormality has been detected in a time period in which a fuel-leaking amount (excess fuel amount) does not exceed a predetermined amount. If NO at step S321, the program goes to step S322 at which a predetermined correction value DFPI2 is subtracted from the supply electric current (I) calculated at step S100 of FIG. 2 so as to determine the corrected supply electric current FFPI. In this manner, the supply electric current (I) is decreased to reduce the torque of the F/P 2. That is, the fuel pressure PF is decreased to eliminate the cause of the fuel leakage. The predetermined correction value DFPI2 is set based on the supply electric current (I) at the time when abnormality has been detected.

Then, the program goes to step S323 at which an abnormality-time reference number IFPNE2 of rotations of the F/P 2 used to determine whether or not the abnormal state has been returned to the normal state is calculated from IFPNE2=f (FFP1, Qf), based on the corrected supply electric current FFPI calculated at step S322 and the fuel supply amount Qf. Then, the program goes to step S324 at which it is determined whether or not the actual number FPNE of rotations of the F/P 2 is less than the abnormality-time reference number IFPNE2 of rotations of the F/P 2. If YES at step 324, i.e., if it is determined that the abnormal state has been returned to the normal state, the program goes to step S325 at which the flag XFPF2 indicating the fuel-leaking state is reset to "0". Then, the processing of this routine terminates. If NO at step S324, i.e., if it is determined that the abnormal state still continues, the program skips step S325 and the processing of this routine terminates.

If YES at step S311, i.e., if the time period between the time TFPF1 when abnormality has been detected and the current time has exceeded the predetermined time period TFS2, it is determined that the state of the fuel supply system is in an abnormal state (fuel-leaking state.) Then, the program goes to step S326 at which the diagnostic lamp which informs the driver of an abnormality is turned on. Then, the program goes to step S327 at which the diagnostic code is stored for each type of abnormality. The diagnostic code is kept to be stored until it is checked for repair in a repair shop or the like. Then, the program goes to step S328 at which the engine is stopped to secure safety. Then, the processing of this routine terminates.

The processing procedure to be executed at the start time of the engine is described below with reference to a routine shown in FIG. 12, when it is determined at step S304 that the engine is at the start time.

Figure 12:
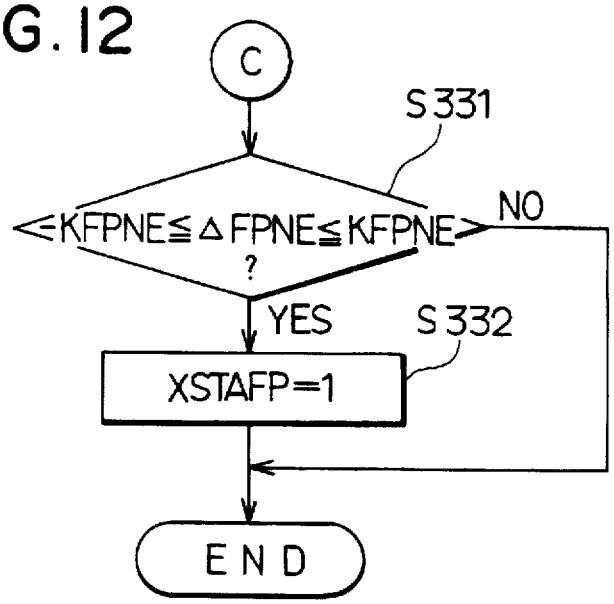
FIG. 12 is a flowchart showing a processing procedure.

FIG. 12 is a flowchart showing a processing procedure, at the start time of the engine, to be performed by the CPU 11 of the ECU 10. It is determined at step S331 whether or not a variation ΔFPNE in the number of rotations of the F/P 2 is in the range from a reference determination value −KFPNE to a reference determination value KFPNE. That is, it is determined whether or not the operation of the F/P 2 has become stable, utilizing the fact that when the fuel supply amount Qf has risen to a set value, the number FPNE of rotations of the F/P 2 becomes constant because the fuel supply amount Qf is almost constant at the start time of the engine. It is to be noted that the reference determination value KFPNE is a value specific to the system and determined depending on a fuel injection method or the like. The reason the reference determination value KFPNE takes a negative value in addition to a positive value is because the variation ΔFPNE in the number of rotations of the F/P 2 changes in the negative side due to an overshoot. If YES at step S331, i.e., if it is determined that the operation of the F/P 2 has stabilized, the program goes to step S332 at which the flag XSTAFP indicating the start time of the engine is set to "1". Then, the processing of this routine terminates. If NO at step S331, i.e., if the variation ΔFPNE in the number of rotations of the F/P 2 is not in the range from the reference determination value −KFPNE to the reference determination value KFPNE, the program skips step S332, thus terminating the processing of this routine.

Another processing procedure to be executed at the start time of the engine is described below with reference to a routine shown in FIG. 13.

Figure 13:
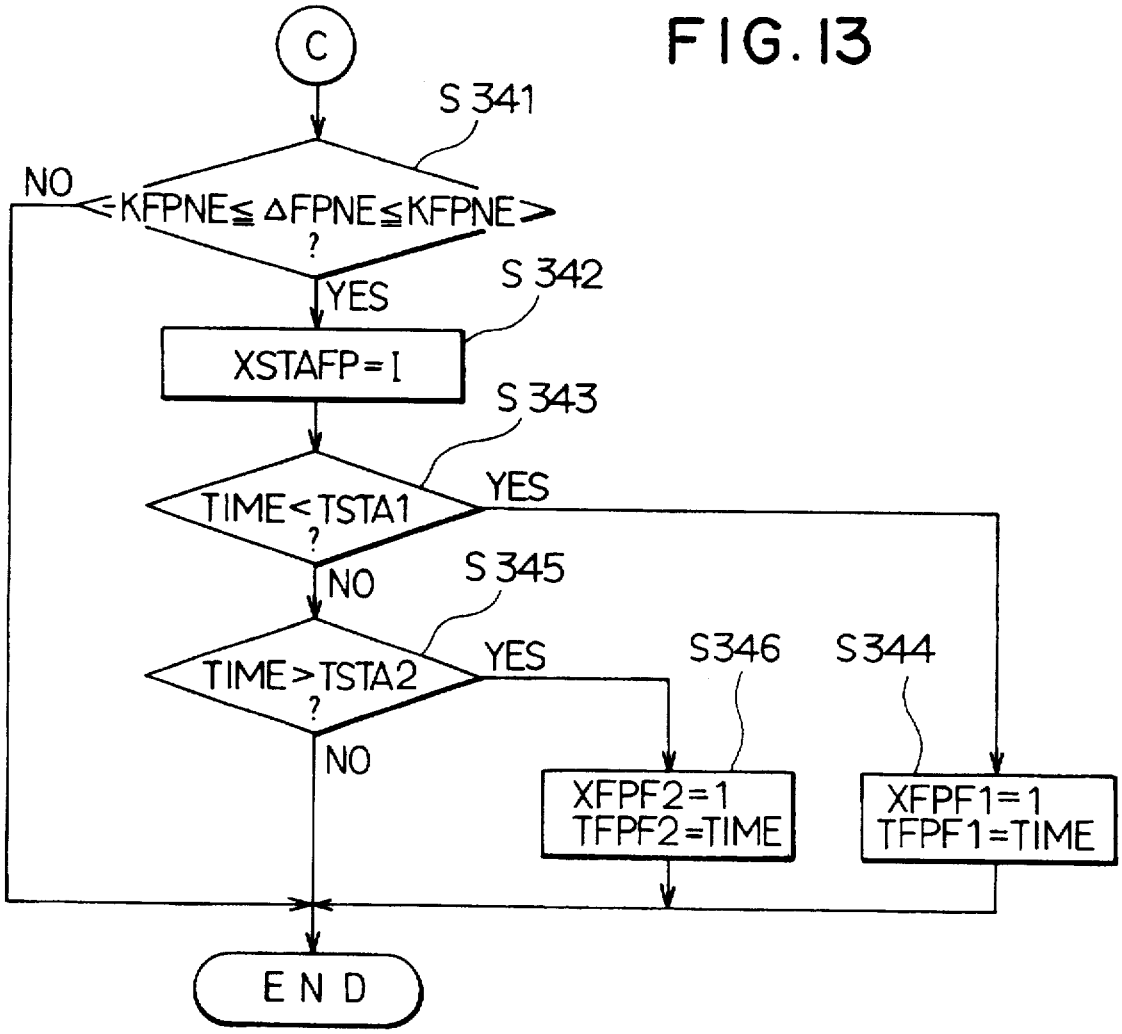
FIG. 13 is a flowchart showing another processing procedure at a start time of the internal combustion engine.

FIG. 13 is a flowchart showing another processing procedure, at the start time of the engine, to be performed by the CPU 11 of the ECU 10. At step S341, processing similar to that to be executed at step S331 of FIG. 12 is executed, and at step S342, processing similar to that to be executed at step S332 of FIG. 12 is executed. Thereafter, the program goes to step S343 at which it is determined whether or not the number FPNE of rotations of the F/P 2 is smaller than the reference number QFPNE of rotations of the F/P 2 by a predetermined deviation α, i.e., it is determined whether or not the time period corresponding to the elapsed time period in relation to the time when the ignition switch is ON is smaller than a time period TSTA1, as shown in FIG. 9. If YES at step S343, the program goes to step S344 at which the flag XFPF1 indicating the locked state or the clogged state is set to "1", and the time when the flag XFPF1 has been set to "1" is stored as the time TFPF1. Then, the processing of this routine terminates.

If NO at step S343, the program goes to step S345 at which it is determined whether or not the number FPNE of rotations of the F/P 2 is greater than the reference number QFPNE of rotations of the F/P 2 by a predetermined deviation β, namely, it is determined whether or not the time period corresponding to the elapsed time period in relation to the time when the ignition switch is ON is greater than a time period TSTA2, as shown in FIG. 9. If YES at step S345, the program goes to step S346 at which the flag XFPF2 indicating the fuel-leaking state is set to "1" and the time when the flag XFPF2 has been set to "1" is stored as the time TFPF2. Then, the processing of this routine terminates.

As described above, in the fuel supply apparatus of the engine according to the embodiment, the CPU 11 of the ECU 10 calculates the reference number QFPNE of rotations of the F/P 2 which applies the predetermined fuel pressure PF to the fuel supply system of the engine, depending on the drive state of the engine. The detection portion 9*a* detects the actual number FPNE of rotations of the F/P 2. The CPU 11 of the ECU 10 calculates the deviation DFPNE in the number of rotations of the F/P 2 between the reference number QFPNE of rotations of the F/P 2 and the actual number FPNE of rotations of the F/P 2. The CPU 11 of the ECU 10 determines that an abnormality has occurred in the fuel supply system when the deviation DFPNE in the number of rotations of the F/P 2 is less than the predetermined lower limit deviation $-\alpha$ in the number of rotations of the F/P 2 or more than the predetermined upper limit deviation $\beta$ in the number of rotations thereof.

Therefore, when the deviation DFPNE in the number of rotations of the F/P 2 is not in the predetermined range, it is determined that abnormality has occurred in the fuel supply system, and the actual number FPNE of rotations of the F/P 2 is controlled so that it is optimum, depending on the drive state of the engine at the time when the abnormality has occurred. In this manner, the apparatus of this embodiment consumes a reduced electric power because excess fuel is not circulated in the fuel supply system, thus accomplishing an improved reliability.

Further, the fuel supply apparatus according to the embodiment prohibits making a determination at the start time of the engine that an abnormality has occurred in the fuel supply system. Accordingly, a normal state can be prevented from being erroneously determined as an abnormal state because an abnormality determination is prohibited at the start time of the engine. That is, because a determination that an abnormality has occurred is not made until the actual number FPNE of rotations of the F/P 2 and the fuel pressure PF become stable, a correct determination can be accomplished.

Further, the fuel supply apparatus of the engine according to the embodiment determines that an abnormality has occurred in the fuel supply system when a rise time period of the fuel pressure PF at the start time of the engine is less than the predetermined time period TSTA1 and more than the time period TSTA2.

Accordingly, if the rise time period of the fuel pressure PF at the start time of the engine is less than the predetermined time period TSTA1 and more than the time period TSTA2, it is determined that an abnormality has occurred in the fuel supply system. In this manner, the apparatus consumes a reduced electric power because excess fuel is not circulated in the fuel supply system, thus accomplishing an improved reliability.

Further, the fuel supply apparatus of the engine according to the embodiment reduces the supply electric current (I) or stops the operation of the F/P 2 upon determination that abnormality has occurred in the fuel supply system. Upon determination that an abnormality has occurred in the fuel supply system, the apparatus reduces the supply electric current (I) or stops the operation of the F/P 2. In this manner, the apparatus consumes a reduced electric power because excess fuel is not circulated in the fuel supply system, thus accomplishing an improved reliability.

Further, the fuel supply apparatus of the engine according to the embodiment increases the electric current (I) upon the abnormality determination. In this manner, the drive sate of the engine can be stabilized by constantly approaching the fuel pressure PF in the fuel supply system to a predetermined pressure. Thus, the apparatus accomplishes an improved reliability.

In addition, in the fuel supply apparatus the operation of the F/P 2 is stopped if a time period in which the supply electric current (I) is controlled exceeds the predetermined time period. In this manner, if fuel leakage is not stopped, the F/P 2 is stopped. Thus, the apparatus can be reliably used.

Figure 14:
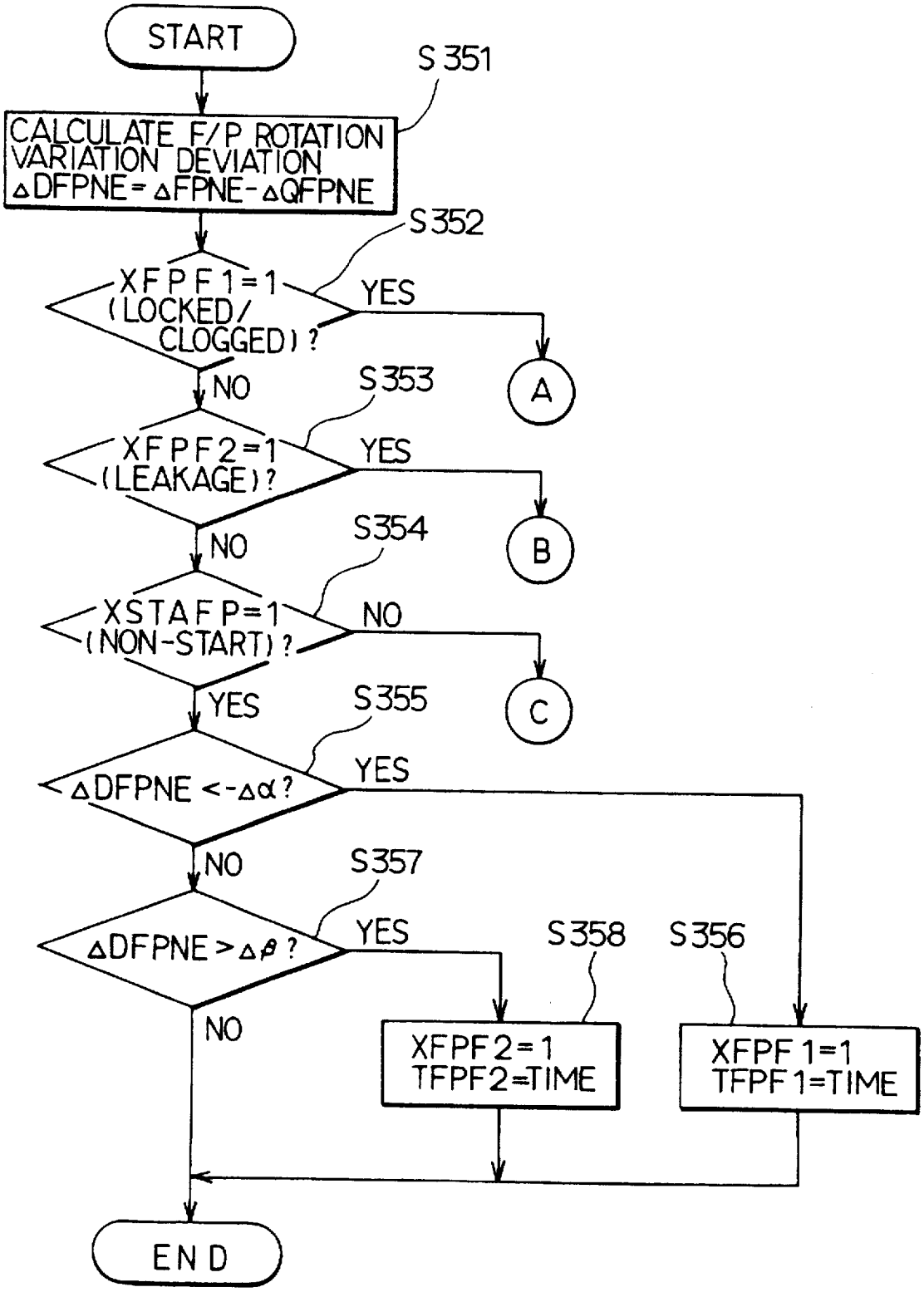
FIG. 14 is a flowchart, similar to FIG. 8, showing another processing procedure of an abnormality detection.

Turning now to FIG. 14 which is similar to FIG. 8, another processing procedure of an abnormality detection to be executed at step S300 shown in FIG. 2 is described.

Initially, at step So, the variation deviation $\Delta$DFPNE in the number of rotations of the F/P 2 is calculated by subtracting the reference variation $\Delta$QFPNE in the number of rotations of the F/P 2 calculated based on the reference number QFPNE of rotations determined at step S202 of FIG. 5 from the actual variation $\Delta$FPNE in the number of rotations of the F/P 2 calculated based on a signal outputted from the detection portion 9*a*. Then, at step S352, it is determined whether or not the variation deviation $\Delta$DFPNE in the number of rotations of the F/P 2 calculated at step So is less than the predetermined lower limit value, i.e., it is determined whether or not the flag XFPF1 has been set to "1". The flag XFPF1 indicates the locked state, namely, the state in which a foreign substance has been caught in the rotational portion of the F/P 2 or the clogged state, namely, the state in which the fuel pipe 4 or 6 has been clogged with foreign substances. If YES at step S352, the processing routine to be used at the locked state or the clogged state is executed.

If NO at step S352, i.e., if the flag XFPF1 which is reset to "0" when the ignition switch has been turned on is "0" because the fuel supply system is not in the locked state or the clogged state, the program goes to step S353 at which it is determined whether or not the variation deviation $\Delta$DFPNE in the number of rotations of the F/P 2 calculated at step So is greater than the predetermined upper limit value, i.e., it is determined whether or not the flag XFPF2 has been set to "1". The flag XFPF2 indicates the fuel-leaking state. If YES at step S353, the processing routine to be used at the fuel-leaking state is executed.

If NO at step S353, i.e., if the flag XFPF1 which is reset to "0" when the ignition switch has been turned on is "0" because the fuel supply system is not in the fuel-leaking state, the program goes to step S354 at which it is determined whether or not the flag XFPF1 has been set to "1". The flag XFPF1 is reset to "0" when the ignition switch has been turned on and indicates the start time period from the time when the ignition switch is turned on until the time when the operation of the F/P 2 becomes stable. It is difficult to calculate the variation $\Delta$QFPNE in the reference number of rotations of the F/P 2 until the fuel pressure at the start time of the engine rises up to the predetermined fuel pressure PF and thus there is a high possibility that an erroneous determination is made. Thus, if NO at step S354, the processing routine to be used at the start time of the engine is executed.

If YES at step S354, i.e., if the engine is not at the start time of the engine, the program goes to step S355 at which it is determined whether or not the variation deviation $\Delta$DFPNE in the number of rotations of the F/P 2 is greater than the predetermined lower limit variation deviation $-\Delta\alpha$ in the number of rotations of the F/P 2. If YES at step S355, the program goes to step S356 at which the flag XFPF1 indicating the locked state or the clogged state is set to "1", and the time at which the flag XFPF1 has been set to "1" is stored as the time TFPF1. Then, the processing of this routine terminates.

If NO at step S355, the program goes to step S357 at which it is determined whether or not the variation deviation $\Delta$DFPNE in the number of rotations of the F/P 2 is greater than the predetermined upper limit variation deviation $\Delta\beta$ in the number of rotations of the F/P 2. If YES at step S357, the program goes to step S358 at which the flag XFPF2 indicating the fuel-leaking state is set to "1", and the time at which the flag XFPF2 has been set to "1" is stored as the time TFPF2. Then, the processing of this routine terminates. If NO at step S357, the processing of this routine terminates, determining that the state of the fuel supply system is normal because the variation deviation ΔDFPNE in the number of rotations of the F/P 2 is small.

Accordingly, the fifth means calculates the variation ΔQFPNE of the reference number of rotations of the F/P 2 which applies the predetermined fuel pressure PF to the fuel supply system, of the engine, having no return pipe connected with the fuel tank 1 based on the drive state of the engine; the sixth means calculates the variation ΔFPNE in the actual number of rotations of the F/P 2; and the seventh means calculates the variation deviation ΔDFPNE in the number of rotations of the F/P 2 between the variation ΔQFPNE of the reference number of rotations of the F/P 2 calculated by the fifth means and the variation ΔFPNE in the actual number of rotations of the F/P 2 calculated by the sixth means; and the eighth means determines that an abnormality has occurred in the fuel supply system when the variation deviation ΔDFPNE in the number of rotations of the F/P 2 calculated by the variation deviation calculation means (seventh means) is less than the predetermined lower limit variation deviation $-\Delta\alpha$ in the number of rotations of the F/P 2 or more than the predetermined upper limit variation deviation $\Delta\beta$ in the number of rotations thereof.

Therefore, if the variation deviation ΔDFPNE in the number of rotations of the F/P 2 is not in the predetermined range, it is determined that the fuel supply system has a trouble, and the variation ΔFPNE in the actual number of rotations of the F/P 2 is controlled so that it is optimum, based on the drive state of the engine at the time when the abnormality has occurred. In this manner, the apparatus of this embodiment consumes a reduced electric power because excess fuel is not circulated in the fuel supply system, thus accomplishing an improved reliability.

Figure 15:
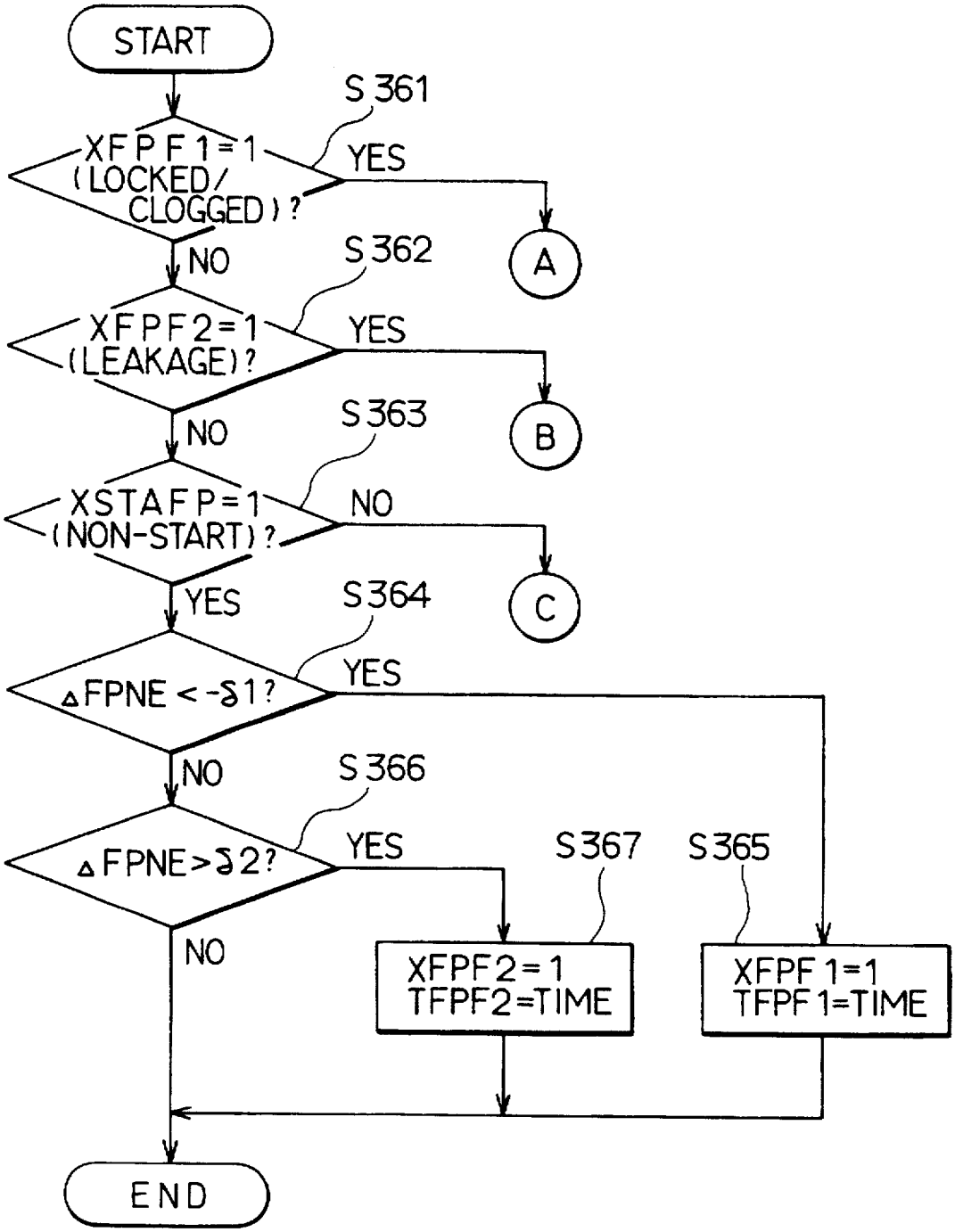
FIG. 15 is a flowchart, similar to FIG. 8, showing still another processing procedure of the abnormality detection.

Turning further to FIG. 15 which is similar to FIGS. 8 and 14, still another processing procedure of an abnormality detection to be executed at step S300 shown in FIG. 2 is explained.

Initially, it is determined at step S361 whether or not the flag XFPF1 has been set to "1". The flag XFPF1 indicates the locked state in which a foreign substance has been caught in the rotational portion of the F/P 2 or the clogged state in which the fuel pipe 4 or 6 has been clogged with foreign substances. If YES at step S361, the processing routine to be used at the locked state or the clogged state is executed.

If NO at step S361, i.e., if the flag XFPF1 which is reset to "0" when the ignition switch has been turned on is "0", i.e., if the fuel supply system is not in the locked state or the clogged state, the program goes to step S362 at which it is determined whether or not the flag XFPF2 has been set to "1". The flag XFPF2 indicates the fuel-leaking state. If YES at step S362, the processing routine to be used at the fuel-leaking state is executed.

If NO at step S362, i.e., if the flag XFPF1 which is reset to "0" when the ignition switch has been turned on is "0", i.e., if the state of the fuel supply system is not in the fuel-leaking state, the program goes to step S363 at which it is determined whether or not the flag XFPF1 has been set to "1". The flag XFPF1 is reset to "0" when the ignition switch has been turned on and indicates the start time period from the time when the ignition switch is turned on until the time when the operation of the F/P 2 becomes stable. If NO at step S363, the processing routine to be used at the start time of the engine is executed because it is difficult to calculate the variation ΔQFPNE in the reference number of rotations of the F/P 2 until the fuel pressure at the start time of the engine rises up to the predetermined fuel pressure PF and thus there is a high possibility that an erroneous determination is made.

If YES at step S363, i.e., if the engine is not in the start time, the program goes to step S364 at which it is determined whether or not the variation ΔFPNE in the number of rotations of the F/P 2 is greater than a predetermined lower limit variation $-\delta 1$ in the number of rotations of the F/P 2. If YES at step S364, the program goes to step S365 at which the flag XFPF1 indicating the locked state or the clogged state is set to "1", and the time at which the flag XFPF1 has been set to "1" is stored as the time TFPF1. Then, the processing of this routine terminates.

If NO at step S364, the program goes to step S366 at which it is determined whether or not the variation ΔFPNE in the number of rotations of the F/P 2 is greater than a predetermined upper limit variation $\delta 2$ in the number of rotations of the F/P 2. If YES at step S366, the program goes to step S367 at which the flag XFPF2 indicating the fuel-leaking state is set to "1", and the time at which the flag XFPF2 has been set to "1" is stored as the time TFPF2. Then, the processing of this routine terminates. If NO at step S366, the processing of this routine terminates, determining that the state of the fuel supply system is normal because the variation ΔFPNE in the number of rotations of the F/P 2 is small.

Thus, if the variation ΔFPNE in the number of rotations of the F/P 2 is not in the predetermined range, it is determined that the fuel supply system has a trouble, and the variation ΔFPNE in the actual number of rotations of the F/P 2 is controlled so that it is optimum, depending on the drive state of the engine at the time when the abnormality has occurred. In this manner, the apparatus consumes a reduced electric power because excess fuel is not circulated in the fuel supply system, thus accomplishing an improved reliability.

Figure 16:
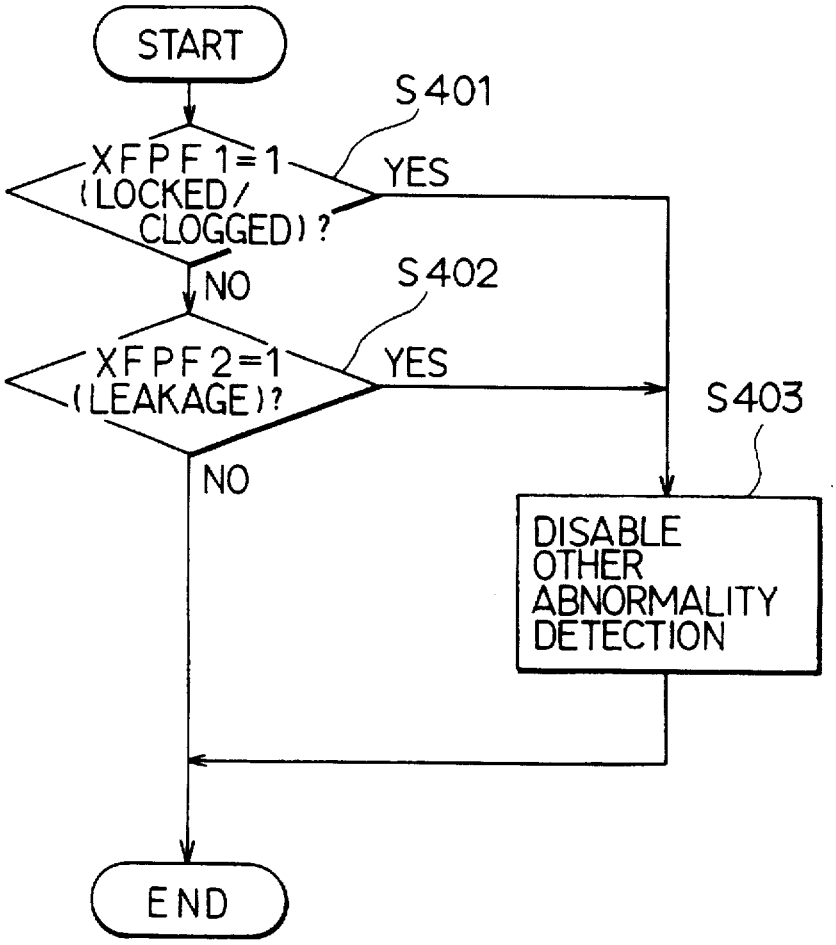
FIG. 16 is a flowchart showing a processing procedure for prohibiting an abnormality detection operation.

FIG. 16 is a flowchart showing a processing procedure in prohibiting an abnormality detection operation from being performed by the CPU 11 of the ECU 10.

It is determined at steps S401 and S402 whether the flag XFPF1 indicating the locked state or the clogged state has been set to "1" and the flag XFPF2 indicating the fuel-leaking state has been set to "1", respectively. If NO at steps S401 and S402, i.e., if it is determined that the fuel supply system has no trouble, the processing of the routine shown in FIG. 16 terminates. If YES at step S401 or at step S402, the program goes to step S403 at which the detection of abnormality of components of the fuel supply system is prohibited. That is, the detection of abnormality of the fuel injection valves 8, the fuel sensor, an air-fuel ratio feedback system or the like is prohibited. Then, the processing of the routine shown in FIG. 16 terminates.

Thus, it does not occur that the fuel injection valves 8, system components of the fuel supply system, for example, the fuel sensor, an air-fuel ratio feedback system or the like is not erroneously determined as being abnormal when it is determined that the fuel supply system is abnormal.

The present invention is not limited to the embodiments described above but may be modified in many other ways without departing from the spirit of the invention.

What is claimed is:

1. A fuel supply apparatus for an internal combustion engine having a fuel pump and a fuel supply system, the apparatus comprising:

calculation means for calculating a reference number of rotations of the fuel pump which changes as a function of a drive state of the internal combustion engine;

detection means for detecting an actual number of rotations of the fuel pump; and abnormality determination means for determining whether an abnormality has occurred in the fuel supply system of the internal combustion engine based on the said reference number of rotations of the fuel pump and the said actual number of rotations of the fuel pump.

2. The fuel supply apparatus of the internal combustion engine according to claim 1, wherein:

the abnormality determination means includes abnormality-time control means which determines that an abnormality has occurred in the fuel supply system when the actual number of rotations is smaller than a value obtained by subtracting a predetermined value from the reference number of rotations, thus increasing electric current to be supplied to the fuel pump.

3. The fuel supply apparatus of the internal combustion engine according to claim 1, wherein:

the abnormality determination means includes abnormality-time control means which determines that an abnormality has occurred in the fuel supply system when the actual number of rotations is greater than a value obtained by adding a predetermined value to the reference number of rotations, thus reducing or stopping electric current to be supplied to the fuel pump.

4. The fuel supply apparatus of the internal combustion engine according to claim 1, wherein:

the abnormality determination means includes abnormality-time control means which controls electric current to be supplied to the fuel pump so as to avoid occurrence of an abnormality when the abnormality-time control means has determined that the abnormality has occurred in the fuel supply system and which stops electric current from being supplied to the fuel pump when the control of the electric current to be supplied to the fuel pump has continued for more than a predetermined period of time.

5. The fuel supply apparatus of the internal combustion engine according to claim 1, further comprising:

prohibition means for prohibiting the abnormality determination means from making a determination at a start time of the internal combustion engine as to whether an abnormality has occurred in the fuel supply system.

6. The fuel supply apparatus of the internal combustion engine according to claim 1, further comprising:

means for prohibiting a determination as to whether components associated with the fuel supply system are abnormal when the abnormality determination means has determined that the fuel supply system is abnormal.

7. The fuel supply apparatus of the internal combustion engine according to claim 1, wherein:

the reference number of rotations calculation means calculates the reference number of rotations of the fuel pump, based on one of a combination of fuel supply amount and a fuel pressure and a combination of a fuel supply amount and electric current to be supplied to the fuel pump.

8. A fuel supply apparatus for an internal combustion engine having a fuel pump and a fuel supply system, the apparatus comprising:

first means for calculating a variation in a reference number of rotations of the fuel pump as a function of a drive state of the internal combustion engine;

second means for calculating a variation in an actual number of rotations of the fuel pump; and abnormality determination means for determining whether an abnormality has occurred in the fuel supply system of the internal combustion engine based on the said variation in the reference number of rotations of the fuel pump and the said variation in the actual number of rotations of the fuel pump.

9. The fuel supply apparatus of the internal combustion engine according to claim 8, wherein:

the abnormality determination means includes abnormality-time control means which determines that an abnormality has occurred in the fuel supply system when the variation in the actual number of rotations is smaller than a value obtained by subtracting a predetermined value from the variation in the reference number of rotations, thus increasing electric current to be supplied to the fuel pump.

10. The fuel supply apparatus of the internal combustion engine according to claim 8, wherein:

the abnormality determination means includes abnormality-time control means which determines that an abnormality has occurred in the fuel supply system when the variation in the actual number of rotations is greater than a value obtained by adding a predetermined value to the variation in the reference number of rotations, thus reducing or stopping electric current to be supplied to the fuel pump.

11. The fuel supply apparatus of the internal combustion engine according to claim 8, wherein:

the abnormality determination means includes abnormality-time control means which controls electric current to be supplied to the fuel pump so as to avoid occurrence of an abnormality when the abnormality-time control means has determined that the abnormality has occurred in the fuel supply system and which stops electric current from being supplied to the fuel pump when the control of the electric current to be supplied to the fuel pump has continued for more than a predetermined period of time.

12. The fuel supply apparatus of the internal combustion engine according to claim 8, further comprising:

abnormality determination prohibition means for prohibiting the abnormality determination means from making a determination at a start time of the internal combustion engine as to whether an abnormality has occurred in the fuel supply system.

13. The fuel supply apparatus of the internal combustion engine according to claim 8, further comprising:

means for prohibiting a determination as to whether components associated with the fuel supply system are abnormal when the abnormality determination means has determined that the fuel supply system is abnormal.

14. A fuel supply apparatus for an internal combustion engine having a fuel pump and a fuel supply system, the apparatus comprising:

first means for calculating a variation in a number of rotations of the fuel pump which supplies fuel to the fuel supply system of the internal combustion engine and controls a pressure of the fuel; and abnormality determination means for determining whether an abnormality has occurred in the fuel supply system based on the variation in the number of rotations of the fuel pump calculated by the first means being outside predetermined upper and lower limits of variation to be expected during normal engine operations.

15. The fuel supply apparatus of the internal combustion engine according to claim 14, wherein:

the abnormality determination means includes abnormality-time control means which determines that an abnormality has occurred in the fuel supply system when the variation in the number of rotations is smaller than a predetermined value, thus increasing electric current to be supplied to the fuel pump.

16. The fuel supply apparatus of the internal combustion engine according to claim 14, wherein:

the abnormality determination means includes abnormality-time control means which determines that an abnormality has occurred in the fuel supply system when the variation in the number of rotations is greater than a predetermined value, thus reducing or stopping electric current to be supplied to the fuel pump.

17. The fuel supply apparatus of the internal combustion engine according to claim 14, wherein:

the abnormality determination means includes abnormality-time control means which controls electric current to be supplied to the fuel pump so as to avoid occurrence of an abnormality when the abnormality-time control means has determined that the abnormality has occurred in the fuel supply system and which stops electric current from being supplied to the fuel pump when the control of the electric current to be supplied to the fuel pump has continued for more than a predetermined period of time.

18. The fuel supply apparatus of the internal combustion engine according to claim 14, further comprising:

abnormality determination prohibition means for prohibiting the abnormality determination means from making a determination at a start time of the engine as to whether an abnormality has occurred in the fuel supply system.

19. The fuel supply apparatus of the internal combustion engine according to claim 14, further comprising:

means for prohibiting a determination as to whether components connected with the fuel supply system are abnormal when the abnormality determination means has determined that the fuel supply system is abnormal.

20. A fuel supply method for use with an internal combustion engine having a fuel pump and a fuel supply system, the method comprising:

generating a reference value related to fuel pump rotation and which reference value changes as a function of a drive state of the internal combustion engine;

detecting an actual number of fuel pump rotations; and determining whether an abnormality has occurred in the fuel supply system of the internal combustion engine based on the said reference value and the said actual fuel pump rotations.

21. The fuel supply method as in claim 20 wherein:

the determining step includes determining that an abnormality has occurred in the fuel supply system when the actual number of fuel pump rotations is smaller than a value obtained by subtracting a predetermined value from the reference value and, in response, increasing electric current to the fuel pump.

22. The fuel supply method as in claim 20 wherein:

the determining step includes determining that an abnormality has occurred in the fuel supply system when the actual number of fuel pump rotations is greater than a value obtained by adding a predetermined value to the reference value and, in response, reducing or stopping electric current to the fuel pump.

23. The fuel supply method as in claim 20 wherein:

the determining step includes stopping electric current from being supplied to the fuel pump when a detected abnormality has continued for more than a predetermined period of time.

24. The fuel supply method as in claim 20 further comprising:

an abnormality determination at a start time of the internal combustion engine.

25. The fuel supply method as in claim 20 further comprising:

prohibiting an abnormality determination as to whether specific components associated with the fuel supply system are abnormal when it has been determined that the fuel supply system is abnormal.

26. The fuel supply method as in claim 20 wherein:

the reference value is based on one of: (1) a combination of fuel supply amount and fuel pressure and (2) a combination of fuel supply amount and electric current to be supplied to the fuel pump.

27. A fuel supply method for use with an internal combustion engine having a fuel pump and a fuel supply system, the method comprising:

generating a variation reference value in a reference number of fuel pump rotations as a function of a drive state of the internal combustion engine;

detecting an actual variation value in the number of fuel pump rotations; and determining whether an abnormality has occurred in the fuel supply system of the internal combustion engine based on the said variation reference value and the said actual variation.

28. The fuel supply method as in claim 27 wherein:

the determining step includes determining that an abnormality has occurred in the fuel supply system when the actual variation is smaller than a value obtained by subtracting a predetermined value from the variation reference value and, in response, increasing electric current to the fuel pump.

29. The fuel supply method as in claim 27 wherein:

the determining step includes determining that an abnormality has occurred in the fuel supply system when the actual variation value is greater than a value obtained by adding a predetermined value to the variation reference value and, in response, reducing or stopping electric current to the fuel pump.

30. The fuel supply method as in claim 27 wherein:

the determining step includes stopping electric current from being supplied to the fuel pump when a detected abnormality has continued for more than a predetermined period of time.

31. The fuel supply method as in claim 27 further comprising:

prohibiting an abnormality a determination at a start time of the internal combustion engine.

32. The fuel supply method as in claim 27 further comprising:

prohibiting an abnormality determination as to whether specific components associated with the fuel supply system are abnormal when it has been determined that the fuel supply system is abnormal.

33. A fuel supply method for use with an internal combustion engine having a fuel pump and a fuel supply system, the method comprising:

detecting a variation in number of fuel pump rotations and controlling fuel pressure of the fuel based thereon; and determining whether an abnormality has occurred in the fuel supply system based on the detected variation in the number of fuel pump rotations being outside predetermined upper and lower limits of variation to be expected during normal engine operations.

34. The fuel supply method as in claim 33 wherein:

determining that an abnormality has occurred in the fuel supply system when the detected variation in the number of fuel pump rotations is smaller than predetermined value and, in response, increasing electric current to the fuel pump.

35. The fuel supply method as in claim 33 wherein:

determining that an abnormality has occurred in the fuel supply system when the detected variation in the number of fuel pump rotations is greater than a predetermined value and, in response, reducing or stopping electric current to the fuel pump.

36. The fuel supply method as in claim 33 wherein:

stopping electric current from being supplied to the fuel pump when a detected abnormality has continued for more than a predetermined period of time.

37. The fuel supply method as in claim 33 further comprising:

prohibiting a determination of abnormality at a start time of the engine.

38. The fuel supply method as in claim 33 further comprising:

prohibiting an abnormality determination as to whether specific components connected with the fuel supply system are abnormal when it has been determined that the fuel supply system is abnormal.

* * * * *